US012060692B2

(12) United States Patent
Schupp

(10) Patent No.: US 12,060,692 B2
(45) Date of Patent: Aug. 13, 2024

(54) FIXTURE FOR SECURING INTO A SOIL, AND A METHOD OF SECURING AND MANUFACTURING THE SAME

(71) Applicant: Ørsted Wind Power A/S, Fredericia Skærbaek (DK)

(72) Inventor: Jens Schupp, Gentofte (DK)

(73) Assignee: Ørsted Wind Power A/S, Fredericia (DK)

( * ) Notice: Subject to any disclaimer, the term of this patent is extended or adjusted under 35 U.S.C. 154(b) by 180 days.

(21) Appl. No.: 17/642,587

(22) PCT Filed: Sep. 3, 2020

(86) PCT No.: PCT/EP2020/074598
§ 371 (c)(1),
(2) Date: Mar. 11, 2022

(87) PCT Pub. No.: WO2021/047989
PCT Pub. Date: Mar. 18, 2021

(65) Prior Publication Data

US 2022/0341119 A1 Oct. 27, 2022

(30) Foreign Application Priority Data

Sep. 11, 2019 (EP) ..... 19196816

(51) Int. Cl.
*E02D 5/80* (2006.01)
*E02D 5/04* (2006.01)

(52) U.S. Cl.
CPC ..... *E02D 5/80* (2013.01); *E02D 5/04* (2013.01); *E02D 2600/30* (2013.01)

(58) Field of Classification Search
CPC ..... E02D 5/80; E02D 5/04; E02D 2600/30
USPC ..... 52/155–166
See application file for complete search history.

(56) References Cited

U.S. PATENT DOCUMENTS 2,762,771 A * 9/1956 Preiser ..... C23F 13/08 204/196.18
3,152,059 A * 10/1964 Wellington ..... C23F 13/10 428/650
5,449,563 A 9/1995 Zhang
6,358,397 B1 * 3/2002 Lyublinski ..... C23F 13/04 204/196.24

(Continued)

FOREIGN PATENT DOCUMENTS

DE 102006058668 A1 6/2008
KR 20100042061 A 4/2010

OTHER PUBLICATIONS

International Application No. PCT/EP2020/074598, International Search Report and Written Opinion mailed Jan. 19, 2021, 9 pages.

*Primary Examiner* — Brian D Mattei
*Assistant Examiner* — Omar F Hijaz

(57) ABSTRACT

A fixture for securing into a soil for bearing a load. The fixture comprises body having a foundation section for insertion into the soil. An anode surface and a cathode surface are provided on the foundation section and are electrically connected to one another. The anode surface comprises a metal or metal alloy with a more negative electrode potential than the cathode surface so as to promote electrochemical reactions within regions of the soil at or adjacent the interface between the fixture and the soil for causing a cementation processes to bond soil particles together and to the foundation section.

14 Claims, 3 Drawing Sheets

(56) References Cited

U.S. PATENT DOCUMENTS

| | | | | |
|---|---|---|---|---|
| 2010/0147703 | A1 | 6/2010 | Glass et al. | |
| 2014/0053476 | A1* | 2/2014 | Hurley | E02D 5/80<br>52/155 |
| 2016/0010304 | A1* | 1/2016 | Barrett | E02D 5/56<br>405/259.1 |
| 2016/0010305 | A1* | 1/2016 | Barrett | E02D 5/56<br>405/259.1 |

* cited by examiner

FIXTURE FOR SECURING INTO A SOIL, AND A METHOD OF SECURING AND MANUFACTURING THE SAME

This application is a national stage filing of International Application No. PCT/EP2020/074598, filed Sep. 3, 2020, which claims priority to European Application No. 19196816.3, filed Sep. 11, 2019. The entire disclosures of the afore-mentioned patent applications are incorporated herein by reference.

The present invention concerns a fixture for securing into a soil for bearing a load, a method of securing said fixture, and a method of manufacturing the same. In particular, the present invention concerns soil fixtures such as foundations, anchors and other structural elements secured into the soil, such as sheet walls. Most particularly, the invention concerns fixtures that comprise anode and cathode surfaces that, in the presence of moisture in the soil, promote cementing of the soil particles at or adjacent to the interface between the fixture and the soil.

In this connection, various types of soil fixtures are known. In use, a part of the fixture is inserted into the ground to provide a load-bearing foundation that resists further movement relative to the soil. For example, the foundation section may act to anchor the fixture into the ground to resist loads pulling the fixture out from its embedded position or, in the case of a structural foundation, resist downward or lateral loads to prevent movement of the structure being supported thereby.

A common type of structural foundation is a tubular steel pile, such as those used to support offshore wind turbine generators. One type of tubular steel pile is a monopile, which is formed of an open ended steel tube and is typically installed by pile driving the monopile body into the ground using impacts from a hammer. As the toe end of the monopile is driven deeper into the soil, the driving resistance increases due to a larger lateral surface area beneath the soil surface and the stresses in the soil increasing with depth. This increases the shear forces required to overcome the frictional resistance at the soil/pile interface. Consequently, during installation, a monopile will be driven down into the ground until it reaches the necessary depth required to achieve a desired load-bearing capacity.

Recent investigations have shown, however, that a tubular steel pile's load bearing capacity may change with time after installation. This may be due to various factors. For example, in some scenarios, the soil displaced laterally during the pile driving process causes compressive hoop stresses in the soil around the pile, which may relax over time, leading to an increase of the compressive stresses acting on the pile surface, thereby increasing the pile's load-bearing capacity. In other instances, the settling and shake down of loosened soil after installation may act to enhance the soil structure and thereby increase the shear resistance at the soil/pile interface. To allow for such variances, a significant safety factor is often applied when determining the required load-bearing capacity for a pile design. As such, piles are often driven much deeper than necessary, which not only increases installation and material costs, but also imposes additional structural requirements on the pile itself, besides increasing the drivability risk. At the same time, it is important to recognise that pile setup is a slow process, and historically only the measured set-up behaviour can be accounted for in the design. That is, long-term testing of the pile setup is often very expensive and hence project economics/logistics often mean that this testing cannot be provided for. As such, projects are typically reliant on the results of short-term setup tests, which may not accurately reflect the eventual load bearing capacity.

The present invention therefore seeks to provide an improved fixture to address the above issues.

According to a first aspect of the present invention, there is provided a fixture for securing into a soil for bearing a load, the fixture comprising: a body; a foundation section of the body for insertion into the soil; a cathode surface on the foundation section; and an anode surface on the foundation section and electrically connected to the cathode; wherein the anode surface comprises a metal or metal alloy with a more negative electrode potential than the cathode surface for promoting electrochemical reactions within regions of the soil at or adjacent the interface between the fixture and the soil.

In this way, the present invention may provide an improved soil fixture that utilises self-driven electrochemical processes to promote galvanic cementation of the soil surrounding the foundation section by utilising pore liquid in the soil as an electrolyte. That is, the load-bearing capacity of the fixture may be increased by using the electro-potential difference between the electrodes to cement soil particles to the surface of the foundation section, without needing to apply an external electrical current. As the anode corrodes, the soil at and adjacent the interface with the soil is cemented, thereby increasing the interface friction and enhancing the fixture's capacity to resist compressive, tensile and lateral loads. In effect, the fixture functions as a giant short-circuited battery, with the by-products of the electrochemical reactions causing the surrounding soil to cement.

Preferably, the body further comprises a support section joined to the foundation section and for projecting from a surface of the soil for connection to the load.

In embodiments, the fixture is a foundation or a soil anchor. In this way, the present invention may be applied to foundations, such as pile foundations, for resisting compressive and lateral loads. Equally, the invention may also be applied to soil anchors for anchoring to the ground and resisting pull-out forces. The invention may also be applied to other fixtures, such as sheet walls.

Preferably, the fixture is a pile foundation. The present invention is particularly suitable for improving the shaft friction of pile foundations, especially for offshore applications where the soil's pore space is saturated with water.

Preferably, the foundation section is formed from a metal or metal alloy and provides one of the cathode surface or the anode surface. In this way, the bulk material of the foundation section forms one of the electrodes. For example, the body of the foundation as a whole may be provided from the electrode material, with its foundation section functioning as the electrode once inserted into the soil.

Preferably, the foundation section is formed from a metal or metal alloy with a more positive electrode potential than the anode surface for providing the cathode surface. Such cathodic galvanic fixtures, where the anode is preferentially corroded and the fixture is preserved, are preferred. In anodic galvanic fixtures, where the fixture itself acts as the anode, the level of corrosion of the fixture body may be more difficult to control and ultimately compromise the structural integrity of the fixture. However, in some instances, anodic galvanic fixtures may potentially be advantageous. For example, use may be preferred in certain soils where the increased roughness caused by corrosion over the fixture body may provide a net increase in fixture strength.

Preferably, the anode surface is provided by one or more anodic elements fixed to the foundation section. In this way, the anodic elements may be connected directly onto the surface of the fixture body for electrically connecting the electrodes.

Preferably, the one or more anodic elements are provided as surface coated regions applied to the foundation section. In this way, the anodic elements may be easily formed and securely adhered onto the foundation section.

Preferably, the surface coated regions are applied by spraying, and more preferably by thermal spraying. In this way, a mechanically robust region of anode coating material may be applied to the surface of the foundation section to provide a sufficient volume of the anode for sacrificial corrosion. At the same time, the thickness of the coating can be easily varied to control the amount of cementation. Preferably, the thickness of the thermally sprayed surface coated region is in the range of 0.1 mm to 0.3 mm.

Preferably, the anode surface comprises a plurality of anodic regions dispersed amongst the cathode surface. In this way, regions of anodic reactions may be evenly distributed over the cathode surface for providing a more uniform galvanic cementation around the fixture. This may also allow the speed of the cementation process to be increased by providing a higher number of smaller, more closely spaced, anodic areas.

Preferably, the cathode surface is formed from a more noble metal than the anode surface.

Preferably, the body is formed from steel. More preferably, the body may be formed from structural steel.

Preferably, the anode surface comprises at least one of aluminium, magnesium, zinc, and alloys thereof. Such highly electro-reactive metals are inexpensive and readily available. Furthermore, these metals may also be conveniently applied by thermal or cold spraying.

Preferably, the anodic coatings are applied to the outside surface of the fixture. In the case of monopiles, the soil inside the pile makes relatively little contribution to the pile's overall overturning capacity.

According to a second aspect of the present invention, there is provided a method of securing a fixture into a soil for bearing a load, comprising the steps of: providing a body comprising a foundation section having a cathode surface and an anode surface electrically connected to the cathode; and inserting the foundation section into the soil, wherein the anode surface comprises a metal or metal alloy with a more negative electrode potential than the cathode surface for promoting galvanic corrosion when in contact with the wet soil. In this way, the present invention provides an improved soil fixture method which utilises self-driven electrochemical processes to promote galvanic cementing of the soil surrounding the foundation.

Preferably, the fixture is a pile foundation and wherein the anode surface is provided on a lateral surface of the pile for promoting cementing of the soil at or adjacent the interface between the pile and the soil.

According to a third aspect of the present invention, there is provided a method of manufacturing a fixture for securing into a soil for bearing a load, comprising the steps of: providing a body comprising a foundation section for insertion into the soil and having a surface for forming a first electrode; and providing a second electrode on the surface, electrically connected to the first electrode, and wherein the first electrode forms one of an anode surface and a cathode surface, and the second electrode forms the other of the anode surface and cathode surface, and wherein the anode surface comprises a metal or metal alloy with a more negative electrode potential than the cathode surface for promoting electrochemical reactions within regions of the soil at or adjacent the interface between the fixture and the soil. In this way, an improved soil fixture may be manufactured by forming a second electrode on the fixture surface, for example by applying the second electrode as a region of coating (e.g. by thermal spraying). In use, the difference in electrode potentials between the materials may then thereby promote galvanic cementing of the soil surrounding the foundation section.

Illustrative embodiments of the present invention will now be described with reference to the accompanying drawings, in which.

Figure 1:
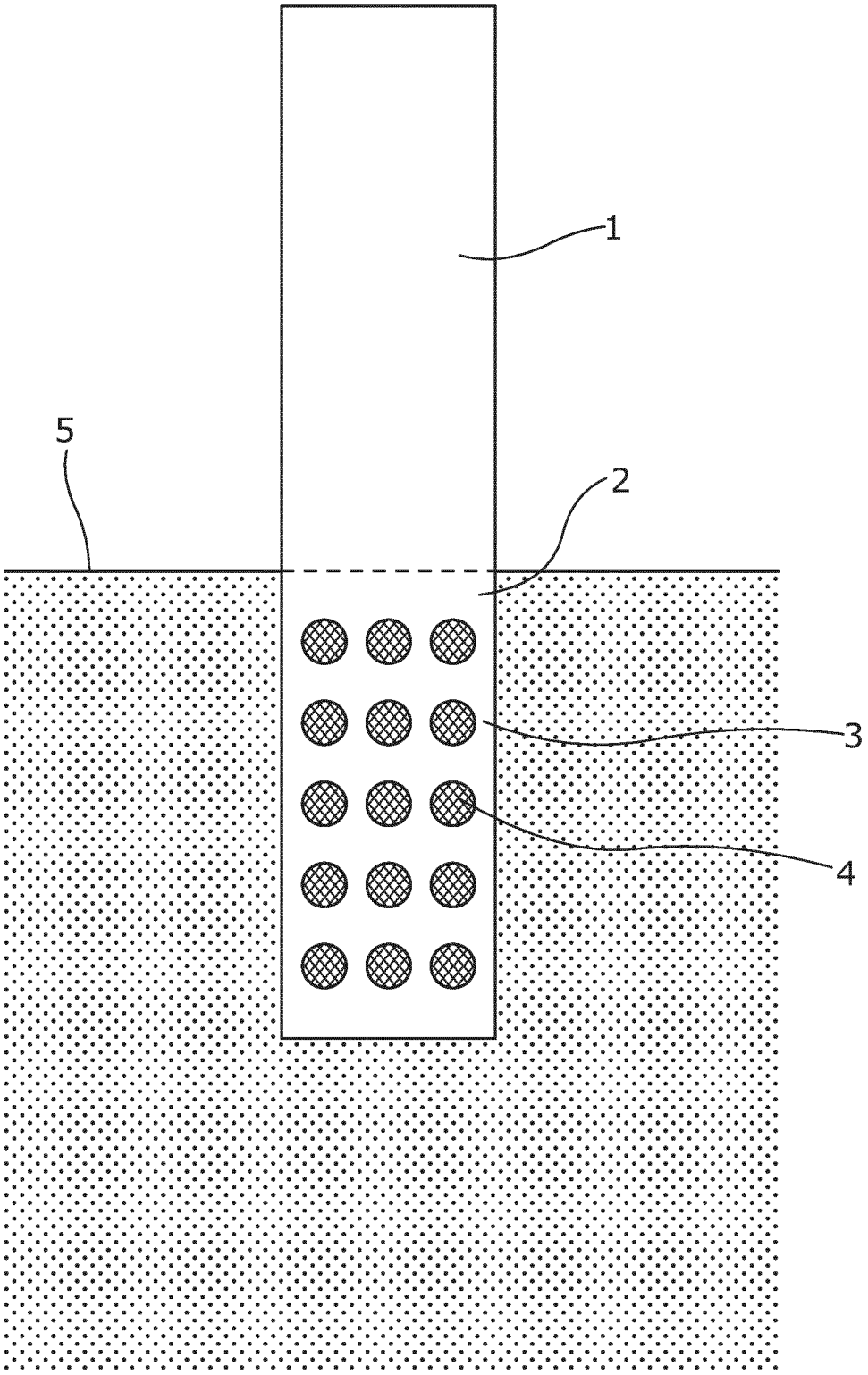
FIG. 1 shows a fixture according to a first embodiment of the invention.
Figure 2:
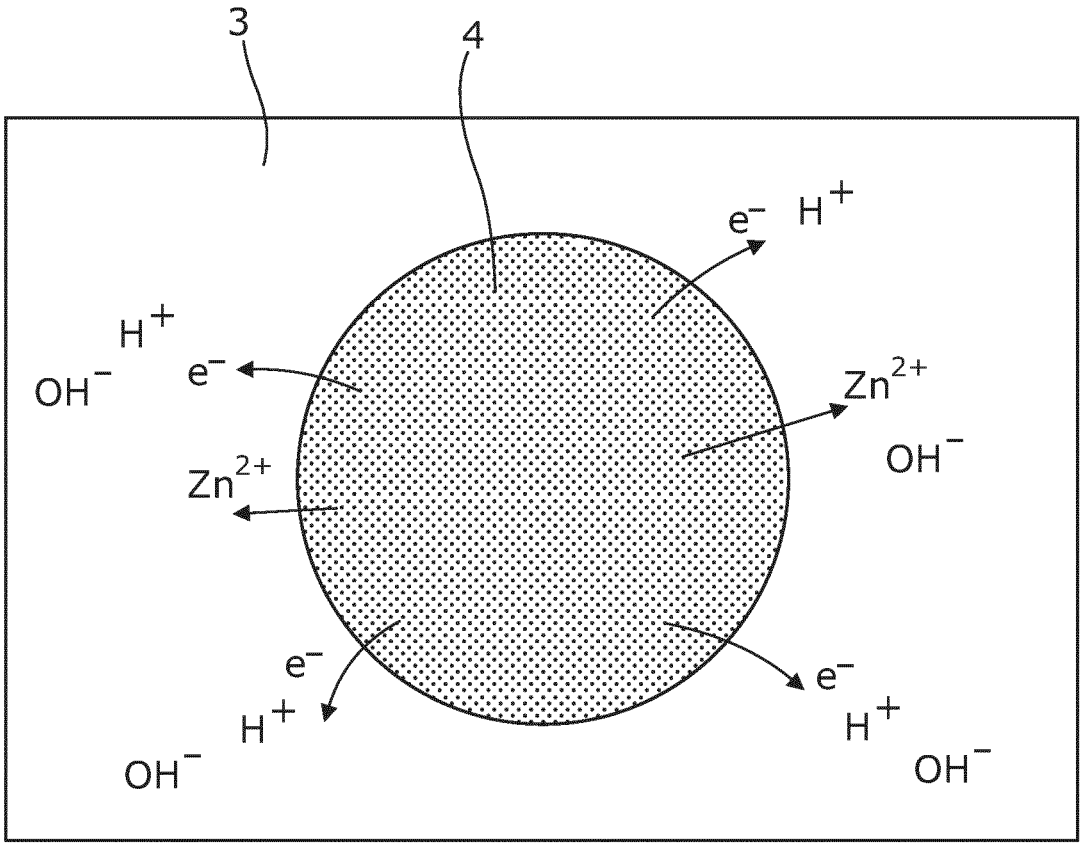
FIG. 2 shows an enlarged schematic view of one anode element on the cathodic pile surface in the first embodiment shown in FIG. 1.
Figure 3:
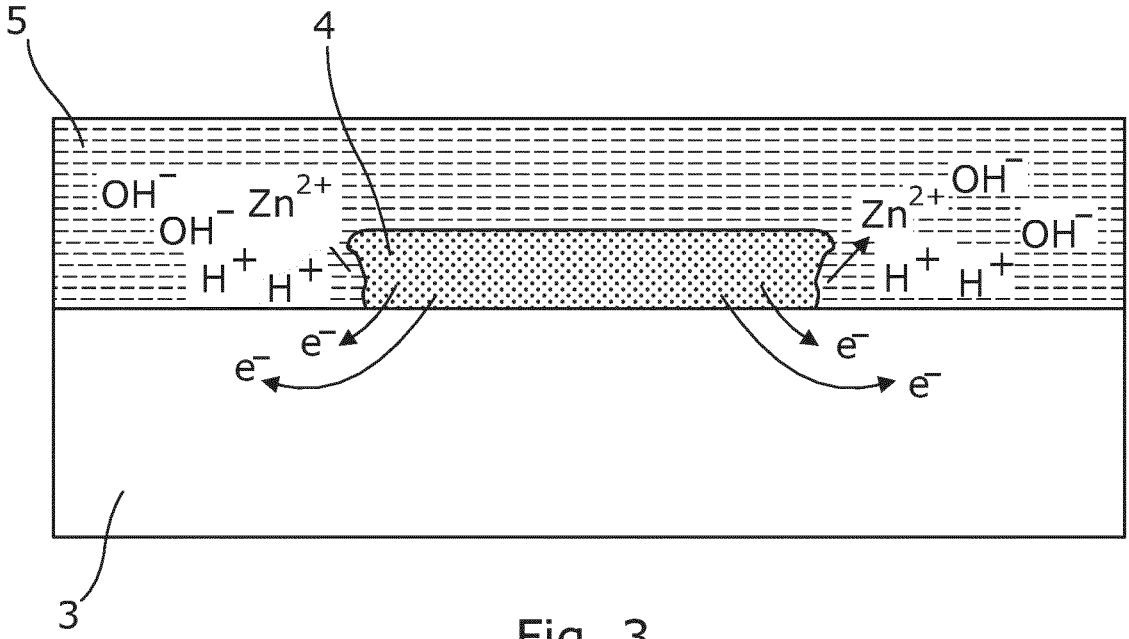
FIG. 3 shows a cross-sectional view of the anode element and cathodic pile surface shown in FIG. 2.

FIGS. 1 to 3 show a fixture for securing into the soil according to a first embodiment of the invention. In this embodiment, the fixture is a monopile foundation that is inserted into the soil 5 by pile driving. The distal end of the monopile body 1 sits beneath the soil and provides a foundation section 2 supporting a support section of the body 1 above it. Once installed, the foundation section 2 may bear the load of a structure attached to the support section.

The foundation section 2 comprises a plurality of anode elements 4 applied by thermally spraying dispersed dot shaped regions of surface coating over the surface 3 of the foundation section 2. It will be understood that in other embodiments, different shaped anode elements 4 and methods of connecting the anode elements 4 to the surface 3 of the foundation section 2 may be used. The anode elements 4 are formed from a less noble metal or metal alloy than the metal or metal alloy forming the surface of the monopile body 1. For example, in this embodiment, the monopile body 1 is formed of steel and the anode elements 4 comprise zinc. As the anode elements 4 are electrically connected to the monopile body 1, the difference in electrode potential between the materials results in the surface 3 of the monopile body 1 becoming a cathode when exposed to moisture in the soil over the foundation section 2. It will be understood that although steel and zinc have been described in this example, other material combinations may be used where there is a difference in electrode potential between the anode and cathode.

FIGS. 2 and 3 show enlarged schematic views of one anode element 4 surrounded by the cathodic surface 3 of the foundation section 2, with FIG. 2 showing a plan view and FIG. 3 showing a cross-sectional view. Once the pile body 1 has been driven into the soil 5, moisture in the soil functions as an electrolyte over the anode and cathode surfaces provided by the anode element 4 and the surface 3 of the foundation section 2, as shown best in FIG. 3. As such, the monopile functions as a galvanic cell in which the anode element 4 is galvanically corroded. That is, the zinc anode element 4 has a lower electrode potential than the steel cathode surface 3, causing it to oxidise as electrons e are donated to the more noble steel. This causes the zinc to corrode, releasing $Zn^{2+}$ ions in an anodic reaction. At the same time, the electrons e given up by the anode element 4 flow into the cathode 3 where they are discharged in a cathodic reaction forming hydrogen. In essence, the monopile functions as a short-circuited battery as electrons flow from the anode to the cathode through the electrically conductive foundation body.

As the galvanic corrosion of the anode elements 4 continues over time, $Zn^{2+}$ ions are released into the soil surrounding the foundation section 2, along with other oxides and carbonate minerals. Calcareous and magnesium minerals from salt water in the soil may also be precipitated around the monopile shaft, due to hydroxide chemical over-potential. The precipitation of these ions and minerals have surprisingly been found to cause agglomeration within the adjacent soil as the metal ions form new structures with the soil particles. This has a cementing effect in the adjacent soil, increasing adherence at the interface between the soil and the monopile body. The new soil structures may also act to expand the soil as the proportion of solids increases. This acts to increase the compressive forces pressing against the monopile, thereby potentially further increasing the frictional resistance over the monopile surface. As a result, the load-bearing capacity of the foundation section 2 is increased, thereby providing a more secure fixture.

Figure 4:
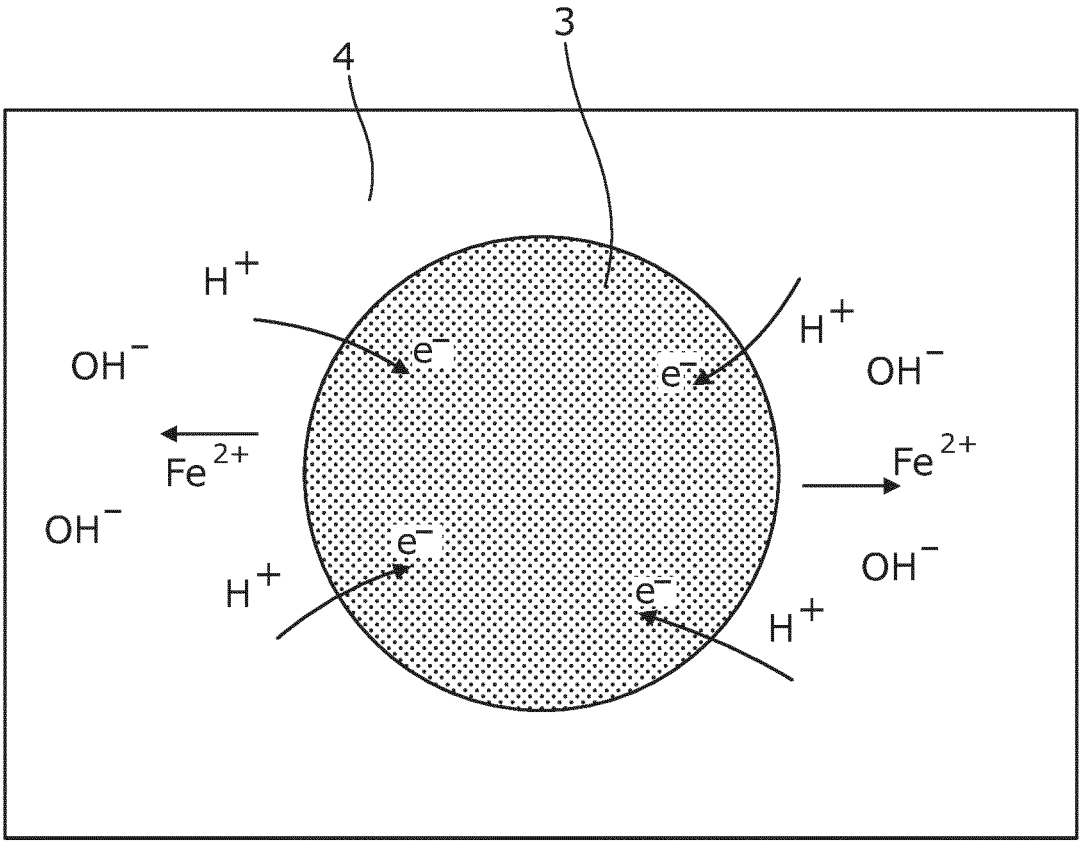
FIG. 4 shows an enlarged schematic view of one cathode element on an anodic pile surface according to a second embodiment of the invention.
Figure 5:
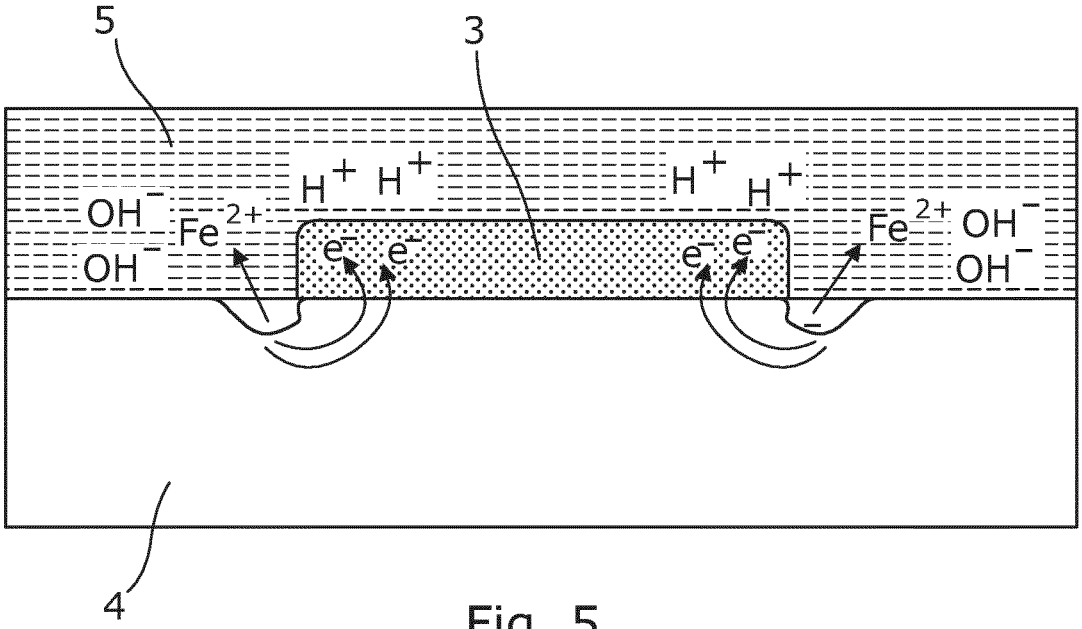
FIG. 5 shows a cross-sectional view of the cathode element and anodic pile surface shown in FIG. 4.

The first illustrative embodiment shown in FIGS. 1 to 3 show a cathodic galvanic pile arrangement in which the anodic elements 4 applied to the monopile body are preferentially corroded. However, it is also possible to provide an anodic galvanic pile arrangement in which the pile itself is preferentially corroded. FIGS. 4 and 5 show such an anodic galvanic pile arrangement surface according to a second embodiment of the invention.

In this connection, FIGS. 4 and 5 show enlarged schematic views similar to those shown in FIGS. 2 and 3, except that the anode and cathode surfaces are reversed. That is, the electrode elements applied onto the surface of the foundation section 2 are cathode elements 3, and the monopile body 1 forms the anode surface 4. The anode surface 4 is formed of a less noble metal or metal alloy than the applied cathode elements 3. For example, in this embodiment, the foundation body 1 may be similarly made of steel, but with the cathode elements 3 being formed from copper, which has a relatively higher electrode potential. In other embodiments, the foundation body 1 may provide a substrate over which a reactive coating is applied to the foundation section 2 to form the anodic surface 4. The cathode elements 3 may then be applied over the reactive coating to provide the difference in electrode potentials between the surfaces.

In use, the second embodiment functions in a similar way to the first embodiment, except that it is the surface 4 of the pile body 1 that is preferentially corroded. That is, the electrode potential of the steel pile is lower than the copper cathode 3, resulting in it reacting anodically to release, amongst others, $Fe^{2+}$ ions and giving up electrons $e^-$ to the copper cathode 3. As the galvanic corrosion of the cathodic pile 4 continues over time, the metal ions released into the soil surrounding the foundation section 2 may cause the precipitation of siderite and iron carbonate, acting to cement the soil. However, whilst this arrangement may provide a larger corroded surface area, a potential negative is that the corrosion of pile body, as shown best in the cross-sectional view in FIG. 5, may ultimately compromise the structural integrity of the foundation. This could feasibly be accounted for in the foundation design, by, for instance, providing thicker walls. The corrosion process may also slow over time due to passivation, e.g. rust on the steel surface or minerals covering the copper surface. Nevertheless, cathodic galvanic pile arrangements, such as that described in the first illustrative embodiment, are generally preferred.

As will be understood from the above, embodiments of the present invention may therefore provide an improved soil fixture that uses self-driven electro-chemical processes to promote galvanic cementing and thereby increase the load-bearing capacity of the fixture in the soil. Embodiments of the present invention may be particularly suitable for marine environments where the soil's water content is relatively high and minerals dissolved in the seawater may be beneficial to the cementation process.

It will be understood that the embodiments illustrated above show applications of the invention only for the purposes of illustration. In practice the invention may be applied to many different configurations, the detailed embodiments being straightforward for those skilled in the art to implement.

For example, it will be understood that different material combinations may be more preferred in certain situations depending on, for instance, ambient soil temperatures or soil composition. For example, metal ions, especially aluminium, are known to interact chemically with clays, but not sands, and therefore aluminium-based anodes may be better suited for galvanic pile systems in clay. Equally, aluminium, magnesium, or zinc anodes may be preferable in oxic conditions and at warmer ambient temperatures, whereas zinc alloy anodes may be preferred in anoxic conditions and at lower ambient temperatures. Similarly, certain electrode materials may be less suitable in certain circumstances or fixture configurations. For example, magnesium electrodes may be less suitable in configurations or soil conditions that could result in the generation of excess reaction gasses.

In addition, although thermally sprayed electrode elements have been disclosed, it will also be understood that electrodes may, for example, also be mechanically connected to the fixture body. For instance, the method of manufacturing the fixture may comprise various techniques to attach electrode elements to the fixture's body, such as by applying the electrode material as a coating, or by bolting or welding one or more electrode elements to the body.

Furthermore, although round electrode elements applied to the surface of the foundation section have been disclosed, it will be understood that the size and geometry of the elements may be varied for different applications. For example, this may be to optimise the galvanic cementation effect, and/or to improve the abrasive resistance of the elements during insertion into the soil. For example, strips of electrode elements may be applied. Other embodiments may comprise coarsely sputter coated regions of electrode applied to the surface of the foundation section. Another alternative would be to coat most of the fixture's surface with one electrode material, and leave some sections of the underlying surface exposed to provide the other electrode surface. For example, the anode surface could be provided by applying a zinc coated area varying from 5 to 95%. For instance, embodiments may comprise different regions within the foundation section, starting with distributed small zinc patches (e.g. covering 5% of the surface area) through stripes (e.g. covering 50% of the surface area) to distributed small cathodic steel patches, which remain uncoated (e.g. the zinc is covering 95% of the surface area).

It will also be understood that, although reference has been made to anode and cathode surfaces, either or both of these surfaces may be provided as a surface on an integral anode or cathode body. For instance, the anode or the cathode may be an integral body which forms the fixture itself or a component of the fixture. As such, the surface of the integral body provides one of the electrode surfaces, and the other electrode may be attached to the body to provide the other electrode surface.

The invention claimed is:

1. A fixture for securing into a soil for bearing a load, the fixture comprising:

a body;

a foundation section of the body for insertion into the soil, wherein an exposed surface of the foundation section of the body forms a cathode surface; and an anode surface provided as a surface coated region applied to the exposed surface and electrically connected to the cathode surface;

wherein the anode surface comprises a metal or metal alloy with a more negative electrode potential than the cathode surface for promoting electrochemical reactions within regions of the soil to cement soil particles at or adjacent the interface between the fixture and the soil without needing to apply an external electric current.

2. The fixture according to claim 1, wherein the body further comprises a support section joined to the foundation section and for projecting from a surface of the soil for connection to the load.

3. The fixture according to claim 1, wherein the fixture is a foundation or a soil anchor.

4. The fixture according to claim 1, wherein the fixture is a pile foundation.

5. The fixture according to claim 1, wherein the foundation section is formed from a metal or metal alloy and provides one of the cathode surface or the anode surface.

6. The fixture according to claim 1, wherein the foundation section is formed from a metal or metal alloy with a more positive electrode potential than the anode surface for providing the cathode surface.

7. The fixture according to claim 1, wherein the anode surface is provided by one or more anodic elements fixed to the foundation section.

8. The fixture according to claim 7, wherein the surface coated regions are applied by thermal spraying.

9. The fixture according to claim 1, wherein the anode surface comprises a plurality of anodic regions dispersed amongst the cathode surface.

10. The fixture according to claim 1, wherein the cathode surface is formed from a more noble metal than the anode surface.

11. The fixture according to claim 1, wherein the body is formed from steel.

12. The fixture according to claim 1, wherein the anode surface comprises at least one of aluminum, magnesium, zinc, and alloys thereof.

13. A method of securing a fixture into a soil for bearing a load, comprising the steps of:

providing a body comprising a foundation section having a cathode surface on an exposed surface of the foundation section and an anode surface electrically connected to the cathode surface, wherein the anode surface is provided as a surface coated region applied to the exposed surface; and inserting the foundation section into the soil, wherein the anode surface comprises a metal or metal alloy with a more negative electrode potential than the cathode surface for promoting galvanic corrosion when in contact with the soil to cement soil particles to the surface or adjacent to the surface of the foundation section, without needing to apply an external electric current.

14. A method of manufacturing a fixture for securing into a soil for bearing a load, comprising the steps of:

providing a body comprising a foundation section for insertion into the soil, wherein an exposed surface of the foundation section forms a first electrode; and providing a second electrode as a surface coated region applied to the exposed surface, electrically connected to the first electrode, and wherein the first electrode forms one of an anode surface and a cathode surface, and the second electrode forms the other of the anode surface and cathode surface, and wherein the anode surface comprises a metal or metal alloy with a more negative electrode potential than the cathode surface for promoting electrochemical reactions within regions of the soil to cement soil particles at or adjacent the interface between the fixture and the soil without needing to apply an external electric current.

* * * * *